US005203744A

United States Patent [19]

Checketts

[11] Patent Number: 5,203,744

[45] Date of Patent: Apr. 20, 1993

[54] DEVICE FOR VERTICALLY OSCILLATING PARTICIPANTS

[76] Inventor: Stanley J. Checketts, P.O. Box 55, Providence, Utah 84332

[21] Appl. No.: 753,335

[22] Filed: Aug. 30, 1991

[51] Int. Cl.[5] ..... A63J 5/12

[52] U.S. Cl. ..... 472/131; 472/137

[58] Field of Search ..... 472/131, 135, 137

[56] References Cited

U.S. PATENT DOCUMENTS

| | | | |
|---|---|---|---|
| 1,482,554 | 2/1924 | Gundlach | 472/137 X |
| 2,221,215 | 11/1940 | Eyerly | 472/131 X |
| 2,229,201 | 1/1941 | Williford et al. | 472/131 X |
| 3,701,528 | 10/1972 | Ryan | 472/131 |

*Primary Examiner*—Richard E. Chilcot, Jr.
*Attorney, Agent, or Firm*—Thompson E. Fehr

[57] ABSTRACT

A vertical tower which participants ascend by means of an internal stairway. At the top of the tower there are several horizontal arms. Each participant walks through a horizontal arm to its open, outward end. The participant is then connected to a resilient band that is also attached to the horizontal arm. Subsequently, the participant leaps from the open, outward end and undergoes dampened vertical oscillations before being lowered to the surface of the earth. The stairway and multiple horizontal arms permit multiple participants to use the device simultaneously and to repeat rapidly the experience. Numerous safety features are employed to prevent injury to the participants.

20 Claims, 7 Drawing Sheets

DEVICE FOR VERTICALLY OSCILLATING PARTICIPANTS

BACKGROUND OF THE INVENTION

1. Field of the Invention

This invention relates to an amusement device in the form of a tower for elevating participants to a high elevation and providing such participants with a means affording a rapid, oscillating descent.

2. Description of the Related Art

There appear to be no prior patents which are significantly similar to the instant invention.

Three patents, however, bear some relationship to the instant invention—U.S. Pat. Nos. 857,338; 2,111,303; and 2,221,215.

The first two of these patents—U.S. Pat. No. 857,338 by inventor Arden S. Fitch and U.S. Pat. No. 2,111,303 by Stanley Switlik—describe towers which elevate and then release parachutes which can be attached to a load or participant. The descent may be guided by a cable or may be unrestrained.

The third patent—U.S. Pat. No. 2,221,215 by inventor Lee U. Eyerly—is somewhat more related to the instant invention in that it produces vertical oscillations of a participant through the use of "resilient members'-'—either rubber bands or springs. The participant, however, rides in a car, a rigid portion of which is maintained inside a slotted track of the supporting tower.

An unpatented activity, i.e., "bungee jumping" is, however, closest to the present invention. In this sport a participant ascends a tower, walks onto a bridge, is hoisted in a basket by a tower crane, or is lifted aloft in the gondola of a hot air balloon with resilient bands, i.e., "bungee cords", tied to the participant's body and to the tower, bridge, basket, or gondola. The participant then leaps from the bridge, tower, basket, or gondola and, because of the interactions between the force of gravity and the elastic force of the bands, undergoes a series of basically vertical oscillations. Dampening produced by air friction and losses of energy within the bands causes the oscillations to cease within a relatively short period of time. The participant must then release the bands and devise some method for descending to the ground or water that is below the participant or ascending to the tower, bridge, basket, or gondola.

Although bungee jumping adds oscillations to the descent one experiences from a tower for parachutes and enhances the participant's freedom of motion as compared to the device disclosed in Eyerly's U.S. Pat. No. 2,221,215, it requires a substantial amount of time after the oscillations cease before the participant and equipment can be readied for a repeat of the experience. The bulk of this time is consumed by the aforementioned ascents and descents subsequent to the oscillatory phase.

A common method for the ascent is climbing a rope to the tower, bridge, basket, or gondola. If the participant first descends from the tower or bridge, the participant must then individually climb the tower or the banks of the river or ravine below the bridge. And if the participant descends from the balloon, the balloon must then land and thereafter again ascend to an appropriate elevation—a not insignificant task considering the limited maneuverability of a hot air balloon.

This problem of time has been only partially solved especially in Australia, through the use of the tower crane which raises the participant to permit the initial leap and which can lower the participant after the oscillations have subsided.

Such a limited solution to the problem of rapid repeatability, though, provides no resolution to the substantially more serious problems of the participant's plummeting to the surface of the earth if there is an equipment failure, being strangled if the band loops around the participant's neck during the oscillations, and being scraped or bruised by the band during the oscillatory phase.

SUMMARY OF THE INVENTION

The instant invention solves these problems.

The problems of rapid repetition is overcome through three (3) means. A vertical tower is constructed which contains a stairway or escalator so that numerous participants can be continuously elevated to the top of the tower. At that point numerous horizontal arms each extend outward to an open, outward end so that several participants can be leaping from such open, outward ends and oscillating simultaneously. And the metal cable from a winch is attached to one end of the resilient band, permitting the participant to be expeditiously lowered to the surface of the earth when the oscillations have subsided and enabling the band to be promptly returned to its original position after it has been detached from the participant.

A number of devices are employed to prevent the participant from falling to earth. Every portion of the vertical tower from which a participant could unintentionally fall—with, of course, the exception of the open, outward end of each horizontal arm, which is (as observed above) intended for leaping, has been enclosed. The participant wears both a chest harness and a pelvic harness, either of which could independently support the participant and both of which are attached to the resilient and with a carabiner—a metal rod bent into a rectangular shape with one side that screws open and closed. The resilient band is composed of two (2) resilient cords with their ends fastened together and to a loop to which the carabiner is attached, assuring adequate support for the participant even if one of the resilient cords fails.

The bands are selected on the basis of the weight of the participant, are also set at an initial elevation dependent upon the weight of the participant, and are attached with a carabiner to a weighted metal loop at the free end of the metal cable from the winch. Also attached to this weighted metal loop is a single resilient cord, the other end of which is connected with a carabiner to the metallic framework of the horizontal arm of the tower near the open, outward end of such arm, i.e., the place from which the participant leaps o deliberately falls. This single resilient cord would preclude the participant from falling should the metal cable fail. When the oscillations—and, consequently, the forces on the metal cable have started to subside, this single resilient cord is released from the tower, permitting the winch and metal cable to lower the participant to the ground.

Should the preceding safeguards fail in connection with a participant's leap or deliberate fall from the open, outward end of a horizontal arm, serious injury to the participant would still be prevented by a safety air bag of the type utilized by professional stunt persons which is placed on the ground in such a manner as to intercept the trajectory of a participant who has leapt or deliberately fallen from the open, outward end of a horizontal arm.

The resilient band is, moreover, suspended from a point directly above the center of the safety air bag so that any induced horizontal oscillations will be minimized, keeping the oscillating participant above the safety air bag. Also, the point of suspension is located a sufficient horizontal distance from the vertical tower that the participant will not come into contact with the vertical tower during the oscillatory phase.

Additional protection is afforded by the fact that the pulley from which the metal cable is suspended is located at an elevation higher than the open, outward end of the horizontal arm and that, during the oscillatory phase, the weighted metal loop is higher than such open, outward end. Energy losses in the resilient band preclude the participant from being oscillated vertically upward with sufficient force to reach the open, outward end and, a fortiori, either the pulley or the weighted metal loop.

And each horizontal arm contains a gate which can be closed until an elevated operator is ready to attach the resilient band to the harnesses worn by the participant and to assist the participant to the jumping platform.

An optional extension to the top of each horizontal arm, furthermore, enables the use of a longer resilient band without increasing the height from which the participant leaps. Thus, the force of gravity will accelerate the participant only to the same speed as it would without the vertical extension; but the added length of the resilient band will allow the resilient band to stretch more than a shorter resilient band, thereby increasing the period of time for, and decreasing the force of, deceleration.

And finally, the risks of strangulation from having the band loop around the participant's neck during the oscillations and of the participant's being scraped or bruised by the bands during the oscillatory phase have been substantially minimized by placing around the resilient band, at the end which connects to the harnesses worn by the participant, a cylinder made from soft foam covered with waterproof material. The cylinder, of course, has a hollow core, running longitudinally through it, to accommodate the resilient band. The length of this cylinder is made proportional to the length of the resilient band.

DESCRIPTION OF THE PREFERRED EMBODIMENT

Figure 1:
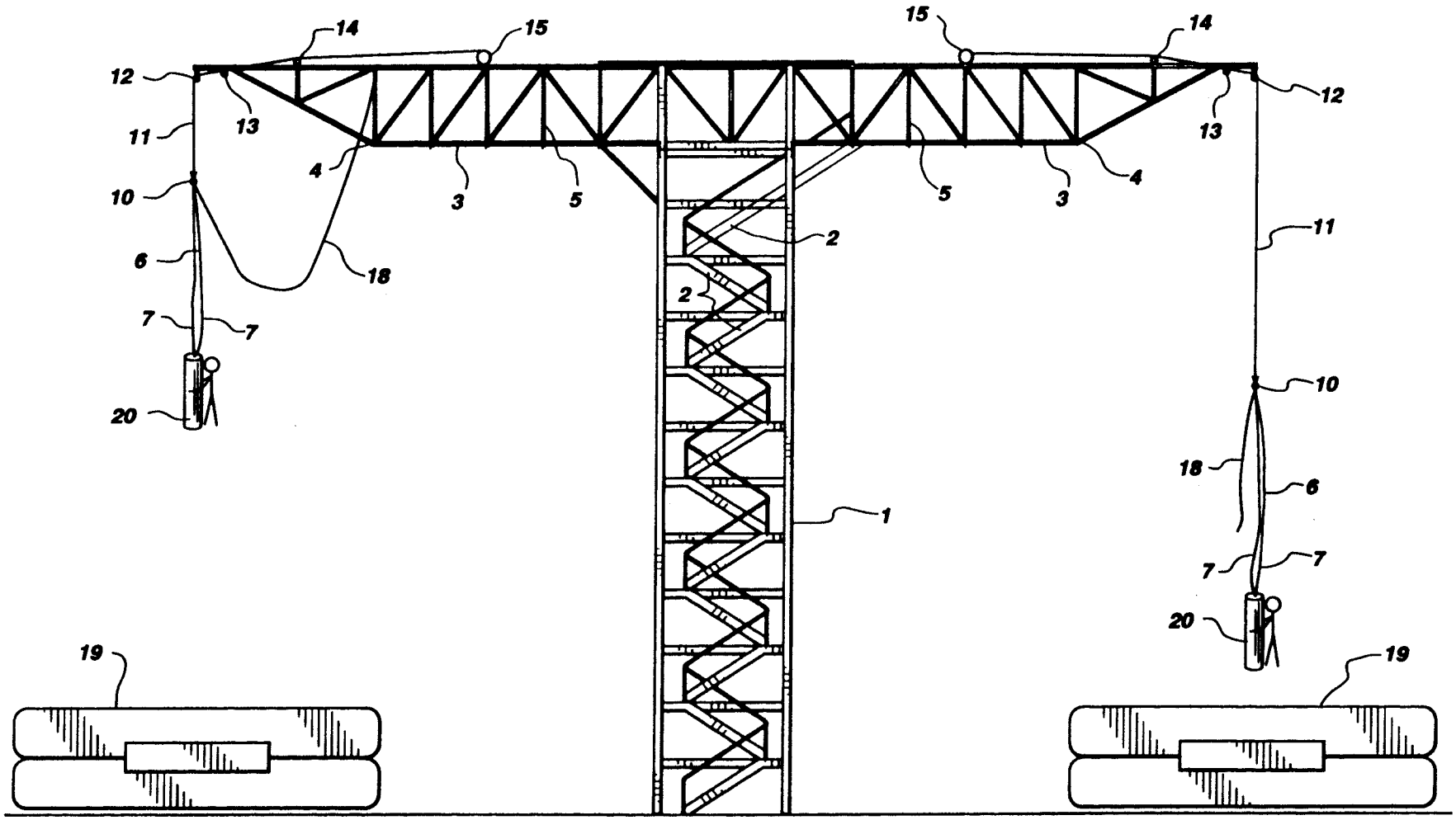
FIG. 1 shows a lateral view of the Device for Vertically Oscillating Participants.
Figure 2:
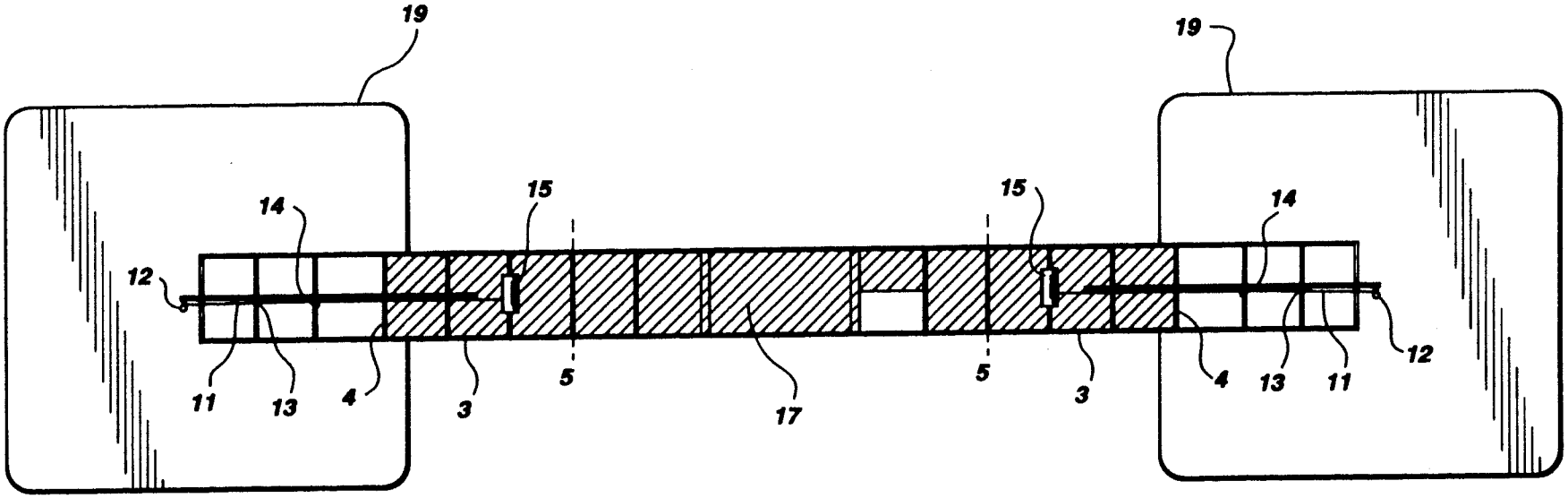
FIG. 2 provides an overhead view of the Device for Vertically Oscillating Participants.

As can be seen from FIG. 1, in the preferred embodiment the elevating means consists of a vertical tower (1) containing a stairway (2), although an escalator or elevator could also be used. The elevating means brings a participant from the surface of the earth to a desired height. (In the preferred embodiments the stairway (2) will laterally exit the vertical tower (1) as it passes to the horizontal arm (3); in order embodiments the stairway (2) will not so exit the vertical tower (1).

Attached to the top of the vertical tower (1) is the means for horizontal movement—one or more horizontal arms (3) which enable a participant to move from the stairway (2) to the means for jumping, which in the preferred embodiment is merely the open, outward end (4) of each horizontal arm (3). A gate (5) is located near the center of each horizontal arm (3) to preclude a participant from entering the open, outward end (4) of the horizontal arm (3) before the operator, one of whom is stationed in each open, outward end (4) of the horizontal arms (3)—is ready to assist such participant.

(Before any operator proceeds beyond the gate (5), such operator attaches a small resilient cord to the horizontal arm (3) and to a pelvic harness worn by the operator.)

Figure 7:
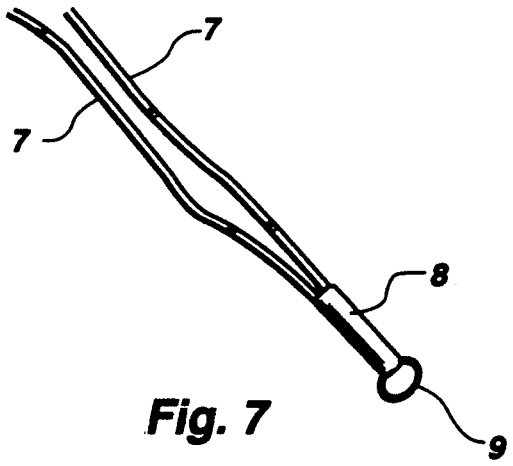
FIG. 7 shows an end of the resilient band without the protective cylinder.

The participant initiates the vertical oscillations by leeping or allowing the participant's body to fall outward and downward from the open outward end (4) of the horizontal arms (3) (i.e., jumping). Gravity, of course, then accelerates the participant. The means for decelerating the participant's descent and producing dampened vertical oscillations is, in the preferred embodiment, a resilient band (6) which is composed of two resilient cords (7), the ends of which are bound together with stitching tape (8). (The resilient cords (7) are so selected that either could safely support the participant.) Attached to each end of the resilient band is a fabric loop (19) of material such as nylon webbing. (The resilient band (6) is shown in FIG. 1; and, in greater detail, in FIG. 7.)

The resilient band (6) is available in four different strengths; and the strength utilized is dependent upon the weight of the participant, which, of course, is grouped within one of four categories. Within each category, the weight of the participant is again assigned to one of four subcategories. The initial vertical position of the resilient band (6) is then adjusted to one of four different points because a heavier individual will stretch a given resilient band (6) more.

The participant wears a chest harness and a pelvic harness. A carabiner, i.e., a metal rod bent into a rectangular shape with one side that screws open and closed, is utilized to connect these harnesses to the fabric loop (9) on one end of the resilient band (6). The fabric loop (9) on the other end of the resilient band (6) is attached to a weighted metal loop (10) on the free end of a metal cable (11) which passes over a lower pulley (12), through a guide (13), and over an upper pulley (14) before reaching a winch (15) that is mechanically fastened to the top of the horizontal arm (3). In the preferred embodiment, the weighted metal loop (10), the metal cable (11), the lower pulley (12), the guide (13), the upper pulley (14), and the winch (15) compose the means for lowering the participant and restoring the decelerating and oscillating means to its original elevated position. (All of these items can be seen in FIG. 1; and some are visible in FIG. 2, FIG. 3, FIG. 4, and FIG. 5.)

After the participant has leaped or deliberately fallen outward and downward from the open, outward end (4) of the horizontal arm (3), gravity will accelerate the participant downward until the participant has traveled a sufficient distance to begin stretching the resilient band (6). The resilient band (6) will, thus, begin to decelerate the participant. The force of the resilient band (6) will become greater as the resilient band (6) is stretched further; eventually the resilient band (6) will exert sufficient force to stop the descent of the participant and propel the participant upward. Because of energy losses in the resilient band (6) and because of air resistance, the resilient band (6) will not exert sufficient force to cause the participant to reach the height of the open, outward end (4) of the horizontal arm (3) before the force of gravity ends the upward motion of the participant. (For this reason it is essential that the lower pulley (12) be at an elevation above the open, outward end (4) and that, during the oscillatory phase, the weighted metal loop (10) also be higher than the open, outward end (4). Gravity will then again accelerate the participant downward, and the entire process will be repeated—but with a decreased amplitude (distance of vertical motion) because of energy losses in the resilient band (6) and because of air resistance.

When these dampened oscillations have sufficiently decreased in amplitude, the winch (15) will be activated to release a greater length of metal cable (11) and, consequently, to lower the participant to the surface of the earth where the resilient band (6) will be detached from the chest harness and the pelvic harness worn by the participant. The winch (15) will then be operated to retract the metal cable (11) and to raise and restore the resilient band (6) to its original position. (In the preferred embodiment the metal loop (10), the metal cable (11), the lower pulley (12), the guide (13), the upper pulley (14), and the winch (15) constitute the means for lowering the participant and for restoring the Device for Vertically Oscillating Participants to its original configuration.) The operator stationed in the open, outward end (4) of the horizontal arm (3) must, however, manually grasp the free end of the resilient band (6) with a hook in order to draw the free end of the resilient band (6) to such operator so that the operator can either attach the free end of the resilient band (6) to another participant or to replace the resilient band (6) with another size of resilient band (6) appropriate to the weight of the next participant. (Of course, any such replacement requires the operator to activate the winch (15) to extend a sufficient length of the metal cable (11) so that the operator can draw to the operator the weighted metal loop (10).)

Figure 3:
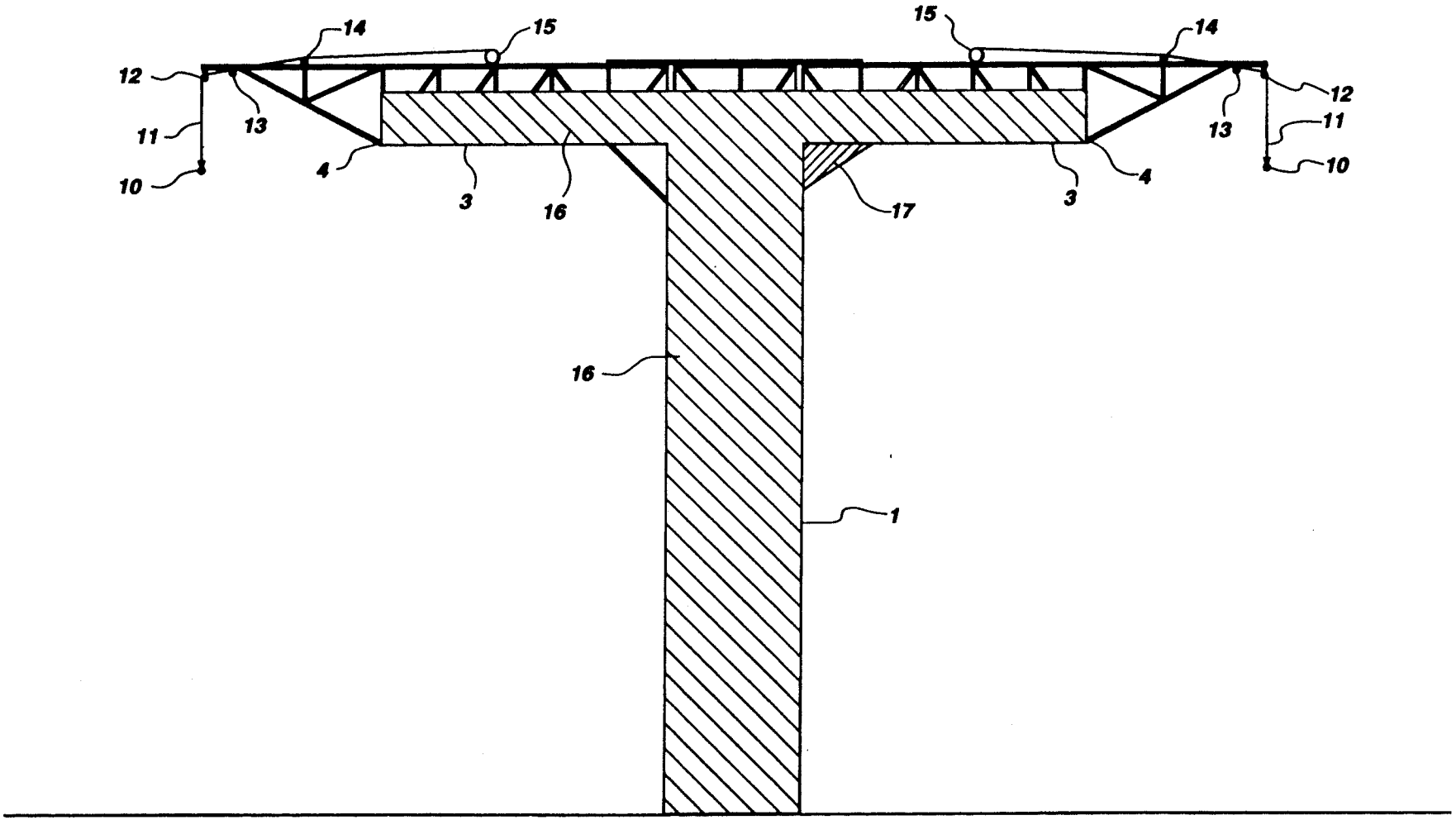
FIG. 3 demonstrates, on a lateral view of the Device for Vertically Oscillating Participants, the locations of chain link fencing and steel mesh.
Figure 4:
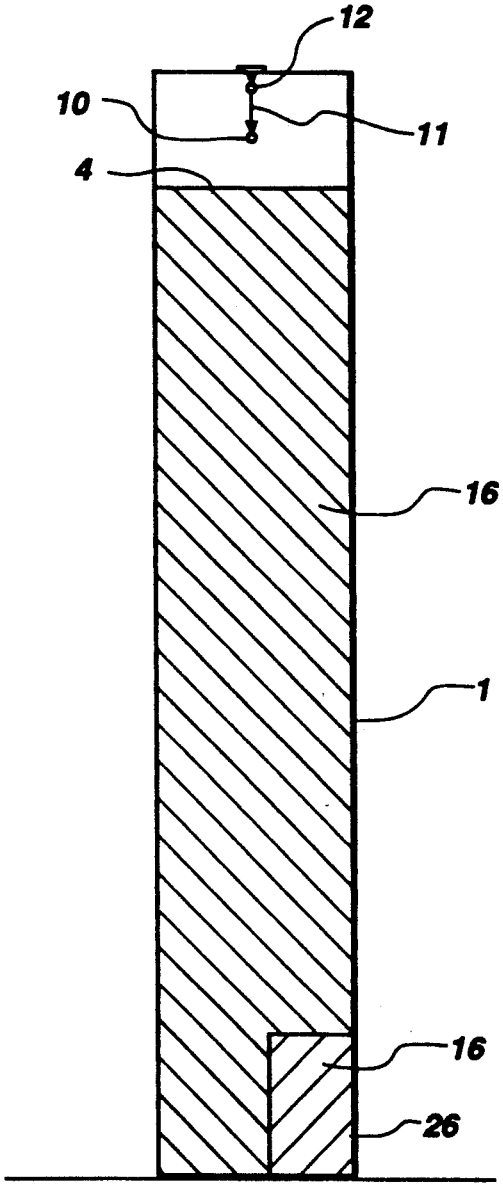
FIG. 4 exhibits, on one end view of the Device for Vertically Oscillating Participants, the positioning of chain link fencing and steel mesh.
Figure 5:
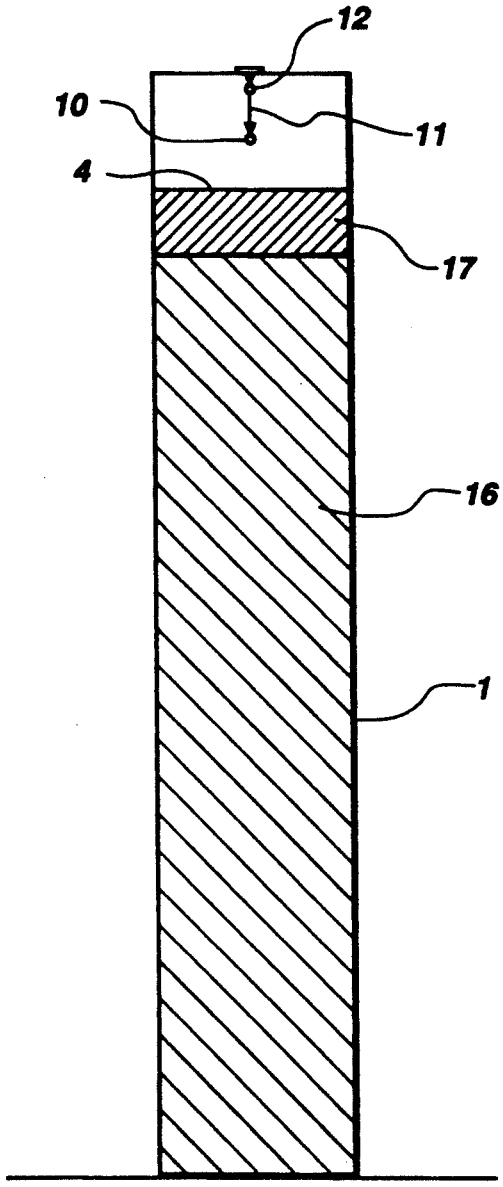
FIG. 5 illustrates, on the other end view of the Device for Vertically Oscillating Participants, the placement of chain link fencing and steel mesh.

As the means for preventing unintentional falls by participants from the elevating means and the means for horizontal movement, the preferred embodiment primarily employs chain link fencing (16) which is attached as can be viewed in FIG. 3, sufficiently high on both sides of each horizontal arm (3) to preclude an accidental fall therefrom and, as can be seen in FIG. 3, FIG. 4, and FIG. 5, to all surfaces of the vertical tower (1) except that portion of the stairway (2) which passes diagonally from the vertical tower (1) to one of the horizontal arms (3). The chain link fencing (16) extends horizontally to the open, outward end (4) of each horizontal arm (3). The means to prevent unintentional falls from the elevating means and the means for horizontal movement, in the preferred embodiment, secondarily employs—steel mash (17) which is connected to the bottom of the horizontal arms (3) and the bottom as well as the sides of that portion of the stairway (2) which passes diagonally from the vertical tower (1) to one of the horizontal arms (3).

In the preferred embodiment, the means for preventing participants from falling should a failure occur in the means for lowering the participant to the surface of the earth and restoring the Device for Vertically Oscillating Participants to its original elevated position—principally, in the preferred embodiment, a failure in the metal cable (11), the lower pulley (12), or the winch (15) is composed of a single resilient cord (18), one end of which is attached to the weighted metal loop (10) and the other end of which is connected to the horizontal arm (3) with a carabiner. After the dampened oscillations have subsided, the single resilient cord (18) is disconnected from the horizontal arm (3) to permit the participant to be lowered to the surface of the earth. This can be seen in FIG. 1.

Also in the preferred embodiment, the means for cushioning the fall of the participant should a failure occur in the means for decelerating the participants' descent and producing dampened vertical oscillations—i.e., in the preferred embodiment, the resilient band (6)—or in both means for lowering the participant to the surface of the earth and restoring the Device for Vertically Oscillating Participants to its original elevated position—i.e., in the preferred embodiment, principally the metal cable (11), the lower pulley (12), and the winch (15)—and the means for preventing participants from falling should a failure occur in the means for lowering the participants to the surface of the earth and restoring the Device for Vertically Oscillating Participants to its elevated position—i.e., in the preferred embodiment, the single resilient cord (18)—is an air bag (19) of the type utilized by professional stunt persons which is placed on the ground in such a manner as to intercept the trajectory of a participant who has leapt or deliberately fallen from the open, outward end (4) of a horizontal arm (3). This can be viewed in FIG. 1 and FIG. 2.

The trajectory can be calculated mathematically or determined experimentally. Generally an experimental determination will be preferable because different participants will push with different force as they leap or fall from the open, outward end (4) of a horizontal arm (3); this will give such participants different initial horizontal velocities and, consequently, somewhat different trajectories. The safety air bag (19) is positioned to accommodate such variances.

Because there is an initial horizontal velocity but no continuous acceleration as is provided vertically by the force of gravity, the trajectory will basically be a parabola. Therefore, by locating the lower pulley (12) and, consequently, suspending the resilient band (6) directly above the center of the safety air bag (19) the participant's trajectory will only begin to put force on and stretch the resilient band (6) when the participant is traveling in an almost vertical direction. This will minimize horizontally oscillations, keeping the participant over the safety air bag (19) during the oscillatory phase.

With the positions of the lower pulley (12); the safety air bag (19); and the open, outward end (4) of the horizontal arm (3) determined relative to one another, it remains merely to find the minimum distance that the lower pulley (12) must be placed horizontally from the vertical tower (1) to assure that such minimal horizontal oscillations as are induced by the trajectory of the participant will not cause the participant to come into contact with the vertical tower (1) during the oscillatory phase. Again this can be done either mathematically or experimentally.

Mathematically, this would be performed by calculating the intersections of two curves. One curve is that which mathematically describes the motion of the end of the resilient band (6) as it pivots on the lower pulley (12) while being stretched by the mass of the participant's body acted upon by the force of gravity. And the second curve is the trajectory of the participant after leaping or deliberately falling from the open, outward end (4) of the horizontal arm (3).

Because the participant acts much like a pendulum suspended by the resilient band (6), to move horizontally farther outward from the point of the lower pulley (12) after the resilient band (6) has reached its maximum length and the participant has stopped all movement, the participant would also have to climb vertically; and this would be impossible without the addition of new energy.

Still, as with determining the relative location of the safety air bag (19), it is preferable to determine experimentally the minimum distance that the lower pulley (12) must be placed horizontally from the vertical tower (1). This is again dictated by the fact that different participants will push with different force as they leap or fall from the open, outward end (4) of a horizontal arm (3).

Figure 6:
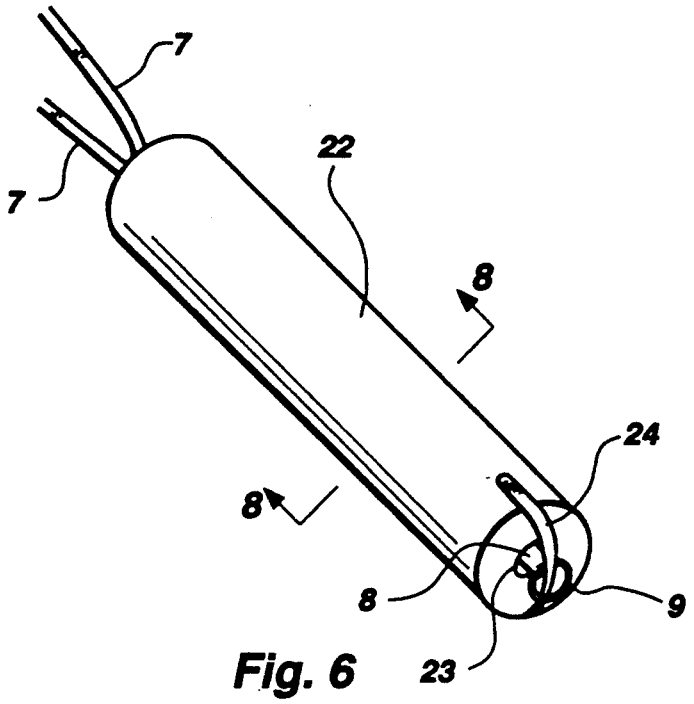
FIG. 6 depicts the protective cylinder attached to the end of the resilient band which is connected to a participant.
Figure 8:
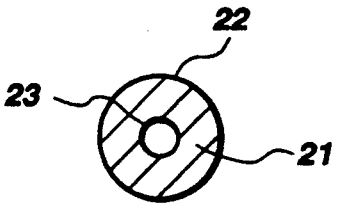
FIG. 8 provides a cross-sectional view of the cylinder.

Finally, in the preferred embodiment, the means for preventing participants from becoming entangled in, scraped with, or bruised by the means for decelerating the participants' descent and producing dampened vertical oscillations—i.e., in the preferred embodiment, the resilient band (6)—is a cylinder (20) (shown in FIG. 1, FIG. 6, and FIG. 8) manufactured from soft foam (21) and covered on its outside surfaces with waterproof covering (22) having a smooth finish. The cylinder (20) has a hollow core (23) running longitudinally through it, to accommodate the resilient hand (6). The length of the cylinder (20) is made proportional to the length of the resilient band (6). A strap (24) made from the same type of material as the waterproof covering (22) is sewn to the waterproof covering (22) near one end of the cylinder (20). To keep the cylinder or the end of the resilient band (6) which is connected to the chest harness and pelvic harness worn by the participant, the strap (24) is run through the fabric loop (9) on the appropriate end of the resilient band (6) and is then attached to the waterproof covering (22) on the cylinder (20) opposite to the location where the strap has been sewn. This attachment is accomplished through any common reusable closing device, such as velcro or a snap.

The compressibility of the soft foam (21) combines with the smoothness of the finish for the waterproof covering (22) to prevent the scrapes or bruises that a participant would suffer from direct, forceful contact with the resilient band (6) during the oscillatory phase. And since the cylinder (20) with its waterproof covering (22) is much stiffer in the longitudinal direction than is the resilient band (6), the resilient band (6) is precluded from looping around the participant.

Figure 9:
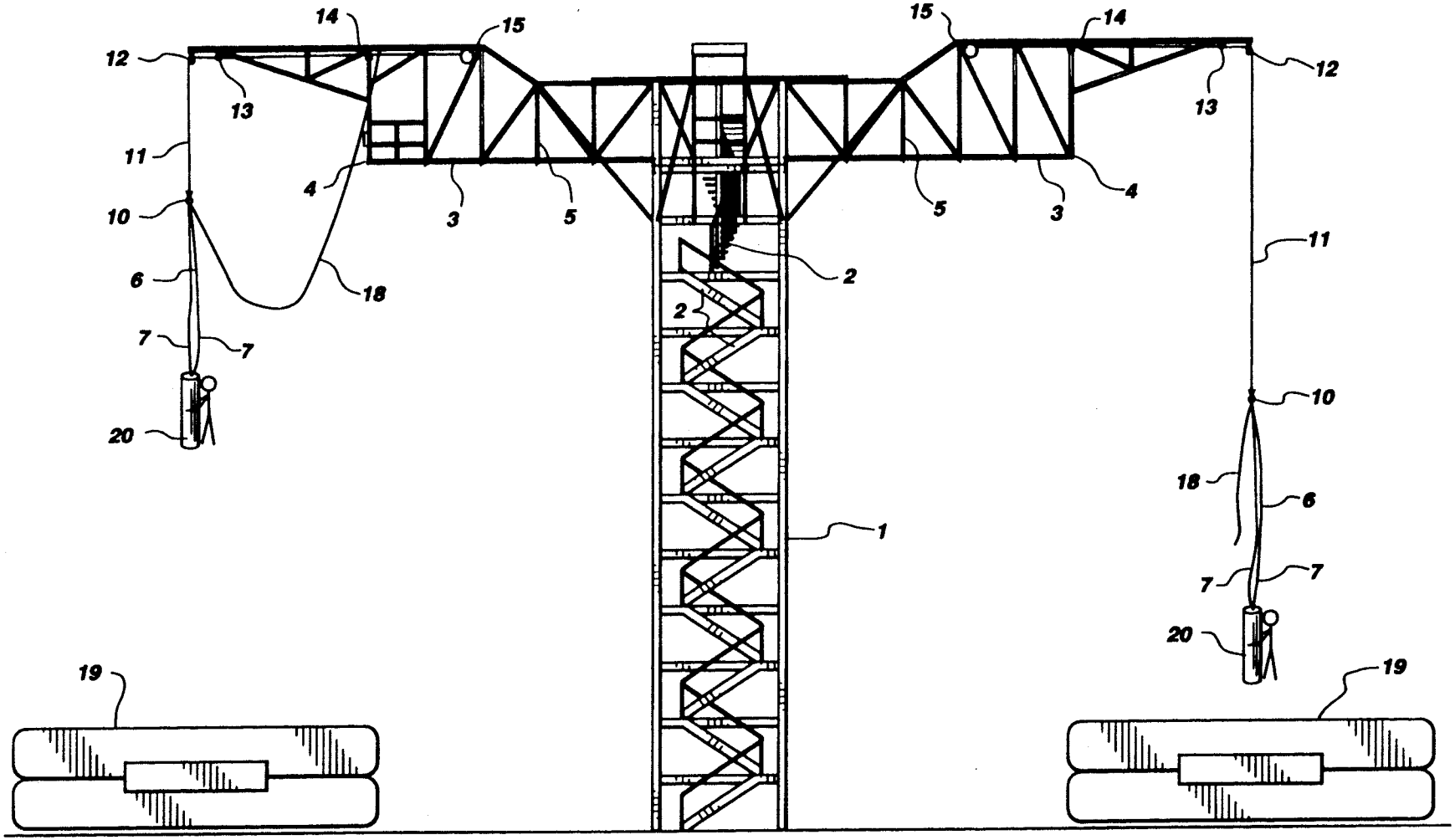
FIG. 9 demonstrates, in a lateral view, an alternate embodiment or optional construction of the Device for Vertically Oscillating Participants.

An optional construction or alternate embodiment employs the addition of a vertical extension (25), as depicted in FIG. 9, above and attached to the horizontal arm (3). When this vertical extension (25) is utilized, the lower pulley (12), the guide (13), and the upper pulley (14) are moved to this vertical extension (25) with the free end of the metal cable (11) passing over or through them, as portrayed in FIG. 9. This permits the use of a longer resilient band (6) without increasing the height from which the participant jumps Thus, the force of gravity will accelerate the participant only to the same speed as it would without the vertical extension; but the added length of the resilient band (6) will allow the resilient band (6) to stretch more than a shorter resilient band, thereby increasing the period of time for, and decreasing the force of, deceleration.

I claim:

1. A device for vertically oscillating participants, which comprises:

an elevating means for bringing participants from the surface of the earth to a desired height;

a means for horizontal movement, which is attached to the top of said elevating means, for moving participants horizontally outward from said elevating means;

a means for jumping, which is connected to the outward end of said means for horizontal movement, to enable the participants to be accelerated downward by the force of gravity;

a means for decelerating the participants' descent and producing dampened vertical oscillations, which is connected to each participant; and a means for lowering the participants to the surface of the earth and restoring the decelerating and oscillating means to its original elevated position, which lowering and restoring means is connected to both the mean for horizontal movement and the decelerating and oscillating means.

2. The device for vertically oscillating participants as recited in claim 1, further comprising:

a means for preventing unintentional falls by participants from the elevating means and the means for horizontal movement, which is connected to said elevating means and to said means for horizontal movement;

a means for preventing participants from falling should a failure occur in the means for lowering the participants to the surface of the earth and restoring the decelerating and oscillating means to its original elevated position, which is connected to the means for horizontal movement and to said means for lowering the participants to the surface of the earth and restoring the decelerating and oscillating means to its original elevated position;

a means for cushioning the fall of the participants should a failure occur in the means for decelerating the participants' descent and producing dampened vertical oscillations or in both the means for lowering the participants to the surface of the earth and restoring the device for vertically oscillating participants to its original elevated position and the means for preventing participants from falling should a failure occur in the means for lowering participants to the surface of the earth and restoring the device for vertically oscillating participants to its original elevation; and a means for preventing participants from becoming entangled in, scraped with, or bruised by the means for decelerating the participants' descent and producing dampened vertical oscillations, which is connected to said decelerating and oscillating means.

3. The device for vertically oscillating participants as recited in claim 2, wherein the means for decelerating the participants' descent and producing dampened vertical oscillations comprises:

two resilient cords, which are attached to each other at both ends and the strength of which is based on the weight of the participants.

4. The device for vertically oscillating participants as recited in claim 2, further comprising:

a gate fastened in the means for horizontal movement between the elevating means and the means for jumping.

5. The device for vertically oscillating participants as recited in claim 4, wherein the means for decelerating the participants' descent and producing dampened vertical oscillations comprises:

two resilient cords, which are attached to each other at both ends and the strength of which is based on the weight of the participants.

6. The device for vertically oscillating participants as recited in claim 2, further comprising:

a means for decreasing the force applied to the participants by the means for decelerating the participants' descent and producing dampened vertical oscillations, which is connected to the top of the means for horizontal movement.

7. The device for vertically oscillating participants as recited in claim 6, wherein the means for decelerating the participants' descent and producing dampened vertical oscillations comprises:

two resilient cords, which are attached to each other at both ends and the strength of which is based on the weight of the participants.

8. The device for vertically oscillating participants as recited in claim 6, further comprising:

a gate fastened in the means for horizontal movement between the elevating means and the means for jumping.

9. The device for vertically oscillating participants as recited in claim 8, wherein the means for decelerating the participants' descent and producing dampened vertical oscillations comprises:

two resilient cords, which are attached to each other at both ends and the strength of which is based on the weight of the participants.

10. A device for vertically oscillating participants, which comprises:

a vertical tower;

a stairway connected to the inside of the vertical tower for bringing participants from the surface of the earth to a desired height;

a horizontal arm connected to said vertical tower and said stairway for moving the participant horizontally outward from the stairway and tower;

an open, outward end attached to said horizontal arm from which the participants may leap or deliberately fall to enable the participants to be accelerated downward by the force of gravity;

a resilient band which is connected to each participant to decelerate the participants' descent and produce dampened vertical oscillations;

a metal cable attached to said resilient band; and a winch attached to said metal cable and said horizontal arm for lowering the participants to the surface of the earth when the oscillations have sufficiently decreased in amplitude and for returning said resilient band to its original elevated position after said resilient band has been disconnected from the participant.

11. A device for vertically oscillating participants as recited in claim 10, further comprising:

chain link fencing attached to all vertical surfaces of the vertical tower and to the sides of the horizontal arm to prevent unintentional falls by the participants;

steel mesh connected to the bottom of the horizontal arm and to the sides and bottom of the stairway as it passes from the vertical tower to the horizontal arm to prevent unintentional falls by the participants;

a single resilient cord connected to the resilient band and, until the oscillations have sufficiently decreased in amplitude that the participant may be lowered, to the horizontal arm to prevent participants from falling should a failure occur in the winch or the metal cable;

a safety air bag which is placed on the ground in such a location as to intercept the trajectory of a participant should a failure occur in either the resilient band or both the single resilient cord and one of the following—the metal cable or the winch; and a cylinder made of soft open-cell foam, having a hollow core running longitudinally through it, covered with waterproof material, and placed around the resilient band at the end which attaches to the participants.

12. The device for vertically oscillating participants as recited in claim 11, wherein the resilient band comprises:

two resilient cords, which are attached to each other at both ends and the strength of which is based on the weight of the participants.

13. The device for vertically oscillating participants as recited in claim 11, further comprising:

a gate fastened in the horizontal arm between the stairway and the open, outward end.

14. The device for vertically oscillating participants as recited in claim 13, wherein the resilient band comprises:

two resilient cords, which are attached to each other at both ends and the strength of which is based on the weight of the participants.

15. The device for vertically oscillating participants as recited in claim 11, further comprising:

a vertical extension connected to the top of and extending outward from the horizontal arm and over which the metal cable from the winch runs.

16. The device for vertically oscillating participants as recited in claim 15, wherein the resilient band comprises:

two resilient cords, which are attached to each other at both ends and the strength of which is based on the weight of the participants.

17. The device for vertically oscillating participants as recited in claim 15, further comprising:

a gate fastened in the horizontal arm between the stairway and the open, outward end.

18. The device for vertically oscillating participants as recited in claim 17, wherein the resilient band comprises:

two resilient cords, which are attached to each other at both ends and the strength of which is based on the weight of the participants.

19. A process for vertically oscillating participants, which comprises:

elevating participants from the surface of the earth to a desired height;

then moving the participants horizontally to a position from which the participants can leap or deliberately fall;

allowing the participants to leap or deliberately fall;

then decelerating the participants' descent;

then using energy generated by such descent to accelerate the participants upward with such force that the participants do not reach the height to which the participants were originally elevated;

then continuing to allow the participants to fall, decelerating the descent of the participants, and using energy generated by the immediately preceding descent to accelerate the participants upward to a height less than that which the participants reached after the immediately preceding acceleration, until losses of energy leave insufficient energy to raise the participants perceptibly; and then lowering the participants to the surface of the earth.

20. The process for vertically oscillating participants as recited in claim 19, further comprising:

preventing the participants from falling while the participants are being elevated or moved horizontally;

protecting the participants from falling while the participants are oscillating;

cushioning any fall of a participant that occurs despite said preventing and protecting;

and ensuring that the participants are not strangled, scraped, or bruised during the oscillating.

* * * * *